United States Patent [19]

Wilson et al.

[11] Patent Number: 4,968,170

[45] Date of Patent: Nov. 6, 1990

[54] TRENCH GRATING AND METHOD OF MANUFACTURE

[75] Inventors: Michael D. Wilson; Dale A. Schmitt, both of Oklahoma City, Okla.

[73] Assignee: Metalines, Inc., Oklahoma City, Okla.

[21] Appl. No.: 311,058

[22] Filed: Feb. 16, 1989

[51] Int. Cl.[5] ..... E01C 11/22

[52] U.S. Cl. ..... 404/2; 404/4; 52/669

[58] Field of Search ..... 404/2, 4, 73; 405/36, 405/40; 210/163, 164; 52/664, 669

[56] References Cited

U.S. PATENT DOCUMENTS

| | | | |
|---|---|---|---|
| 355,330 | 1/1887 | Locke | 404/3 |
| 1,335,623 | 3/1920 | Uris | 52/669 |
| 1,620,846 | 3/1927 | Wells | 52/669 |
| 2,305,955 | 12/1942 | Dudley | 210/164 |
| 3,315,578 | 4/1967 | Wesch et al. | 404/73 |
| 3,420,015 | 1/1969 | Costanzo, Jr. | 52/180 |
| 3,864,887 | 2/1975 | Arens | 52/664 |
| 3,948,013 | 4/1976 | Lobaugh et al. | 52/669 |
| 4,037,383 | 7/1977 | Diebold et al. | 52/664 |
| 4,102,102 | 7/1978 | Greulich | 52/668 |
| 4,126,980 | 11/1978 | Parsons | 52/669 |
| 4,184,303 | 1/1980 | Hassman | 52/669 |
| 4,438,726 | 3/1984 | Osthoff | 119/28 |
| 4,553,874 | 11/1985 | Thomann et al. | 404/4 |
| 4,761,930 | 8/1988 | Tepera | 52/666 |

FOREIGN PATENT DOCUMENTS

| | | | |
|---|---|---|---|
| 414827 | 8/1934 | United Kingdom | 404/2 |

*Primary Examiner*—Stephen J. Novosad
*Assistant Examiner*—Gay Ann Spahn
*Attorney, Agent, or Firm*—Laney, Dougherty, Hessin & Beavers

[57] ABSTRACT

The present invention consists of a metal trench grating and the method of manufacture by which it is constructed. The trench grating consists of plural cross bars having equi-spaced slots and a plurality of elongated rails inserted within the respective cross bar slots, and wherein a single weldment across the bottom of each cross bar provides complete fastening of the assembled trench guard. The method of manufacture stresses simplicity and quick assembly as the plural longitudinal rails are inserted in the plural-slotted cross bars and supported for final welding across the bottom central slot of each cross bar to produce the final form trench grating.

13 Claims, 2 Drawing Sheets

TRENCH GRATING AND METHOD OF MANUFACTURE

BACKGROUND OF THE INVENTION

1. Field of the Invention

The present invention relates to metal gratings and, more particularly, but not by way of limitation, to a method of manufacturing metal gratings that are easy of assembly yet very sturdy and reliable.

2. Description of the Prior Art

Metal gratings have been manufactured and used for a long number of years for providing a solid surface having open sectors for water drainage or air flow. Such gratings have been manufactured variously by cutting, stamping, welding and various combinations of such procedures in order to provide a flat surface having a relatively high percentage of open space therethrough for the purpose of providing walk-over cover for such as floor drains, gutters, and the like. U.S. Pat. No. 3,864,887 provides a teaching of an elongated grating which is constructed with spaced parallel rails fastened to transverse carrier bars. It utilizes an interlock construction wherein each elongated rail includes a lower zig-zag profile portion that slidably engages within a similar shaped zig-zag notching within the transverse carrier bar. A plurality of such longitudinal rails are secured within plural transverse carrier bars to constitute the elongated, rectangular grating.

U.S. Pat. No. 4,184,303 provides a similar teaching of a specially notched cross bar or tie bar which receives a plurality of T-shaped flooring rails slidably therein. This grating assembly is characterized by a relatively ornate cutting and forming procedure to provide the necessary slide mating and matching of members. U.S. Pat. No. 3,948,013 provides a steel grating formed of a plurality of spaced parallel bearing bars that are secured to one another in spaced relationship by plural parallel cross rods. The cross rods are cold forged into permanent engagement with the bearing bars to bring rigidity to the structure.

An early U.S. Pat. No. 1,335,623 provides a teaching wherein a plurality of elongated rails receive a plurality of square rods through mating holes. Each rail/rod juncture is provided with interlocking slotted engagement and the rail members are hammered or forged to retain the cross bars in final assembly. Finally, another early U.S. Pat. No. 1,620,846 provides a teaching wherein a plurality of cross bars are formed with a number of spaced upper slots, each of which receives a longitudinal bar therein. The longitudinal bars are then subjected to a punch press action at both an upper surface and a lower surface within the cross bar slot structure to cause a locking metal expansion thereby providing necessary rigidity to the elongated grating. Other U.S. Patents of more generalized nature relative to the present disclosure are submitted by Information Disclosure.

SUMMARY OF THE INVENTION

The present invention consists of a metal trench grating consisting of plural, slotted cross bar members and a parallel alignment of elongated, longitudinal rails supported within respective cross bar slots and retained therein in welded affixure. The trench grating is preferably formed from aluminum utilizing aluminum welding techniques in making the longitudinal bar/cross bar welds. Each cross bar includes a plurality of equi-spaced rail slots formed transversely through the upper side of the cross bar as well as a transverse slot formed centrally along the cross bar bottom sufficiently deep to communicate with the respective rail slots. A plurality of longitudinal bars or rails are then engaged in each of the rail slots and a weld is drawn across the cross slot to secure each respective elongated rail at the cross bar.

Therefore, it is an object of the present invention to provide a metal grating structure that is strong yet simple of construction in any combination of dimensions.

It is also an object of the invention to provide a gridding technique that enables simple, yet reliable assembly of decorative grating structure wherein the metal welds are maintained out of sight.

It is still another object of the present invention to provide an aluminum or bronze grating structure having load bearing and wearability characteristics comparable to other gratings.

Finally, it is an object of the invention to provide a trench grating that may be quickly assembled and easily welded to provide a final grating structure that is strong while having pleasing decorative effect.

Other objects and advantages of the invention will be evident from the following detailed description when read in conjunction with the accompanying drawings which illustrate the invention.

DETAILED DESCRIPTION OF THE INVENTION

Figure 1:
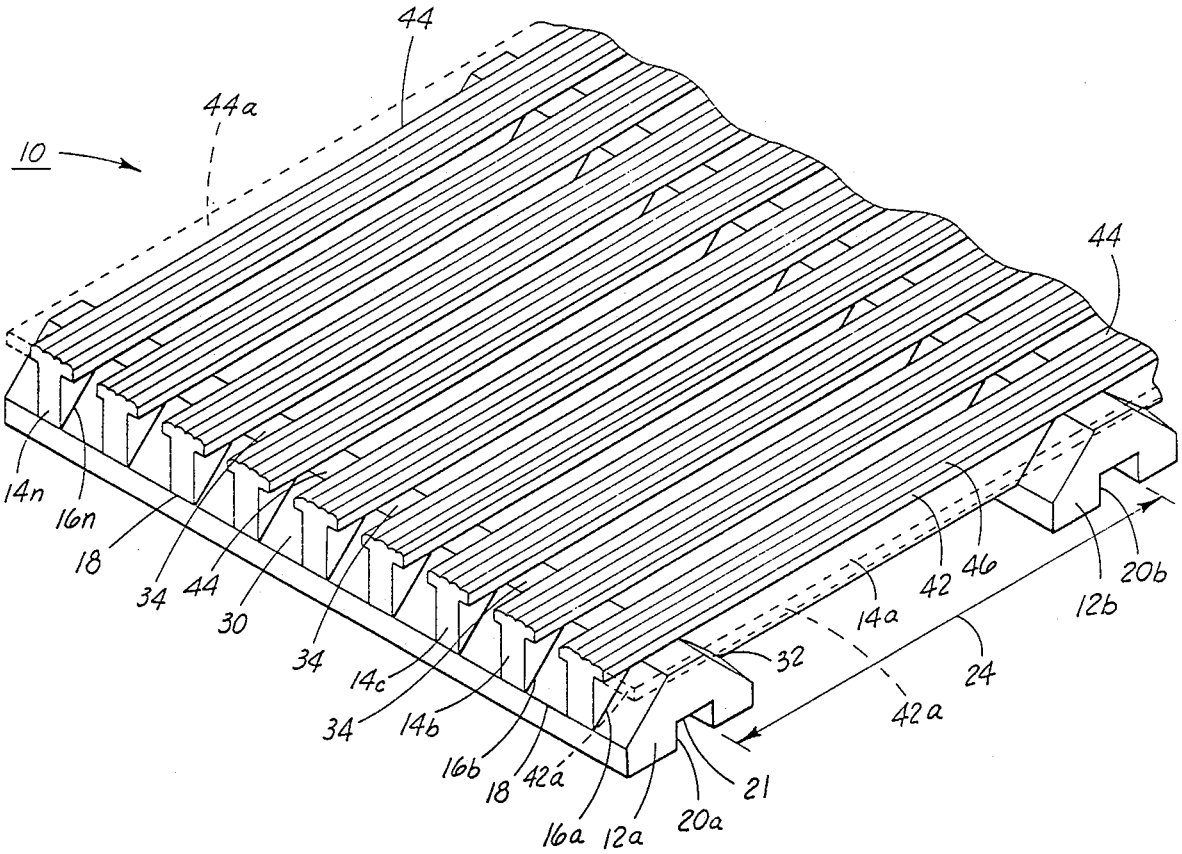
FIG. 1 is a perspective view of an end portion of a trench grating as constructed in accordance with the present invention.

Referring to FIG. 1, a trench grating 10 consists of a plurality of cross bars 12 affixed in interlocking grid relationship with a plurality of longitudinal rails 14. Each cross bar 12 includes a plurality of upper rail slots 16 which are formed in equi-spaced parallel manner down to a support level 18 of cross bar 12. Each cross bar 12 also includes a longitudinal (i.e., relative to the cross bar) weld slot 20 formed centrally along a bottom surface 21 and extending upward to support level 18 so that the weld slot 20 communicates centrally with each rail slot 16.

Figure 2:
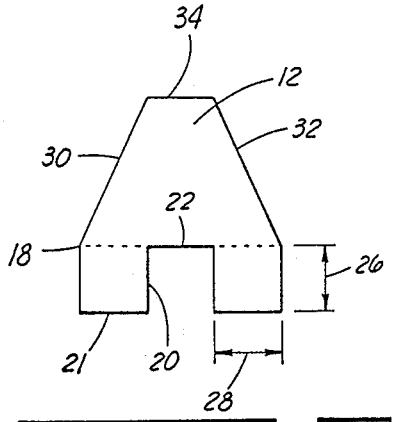
FIG. 2 is an end view in vertical elevation of a cross bar employed in the invention.
Figure 3:
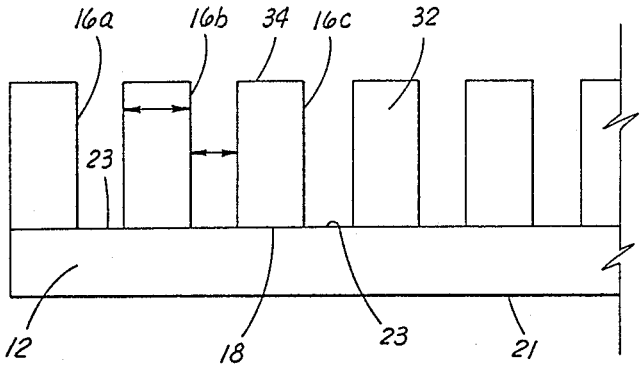
FIG. 3 is a side view in vertical elevation of a portion of a cross bar.

As shown in FIG. 2, as the respective slots 16 are formed down to support plane or level 18 and weld slot 20 is transversely formed up to support level 18. The central slotted surface 22 will have square openings 23 within each of slots 16 thereby to enable weld contact between the bar and rail members. In FIG. 1, the dimension 24 between successive cross bars 12 is readily variable in the initial parts set-up prior to the welding operation and it may be varied in accordance with load bearing requirements. Similarly, and referring to FIGS. 2 and 3, the dimensions 26 and 28 may be varied in accordance with the size of slot 20 adjoining rail slots 16. These will be design choices dictated by performance requirements of the grating. The slope sides 30 and 32 of cross bar 12 are shown as being angularly tapered, and this is done primarily to avoid collection and build-up of debris in the grating structure. Also, the height of cross bar 12 is a critical dimension since the top surface 34 preferably falls flush with any overhanging rail structure, as will be further described below.

Figure 4:
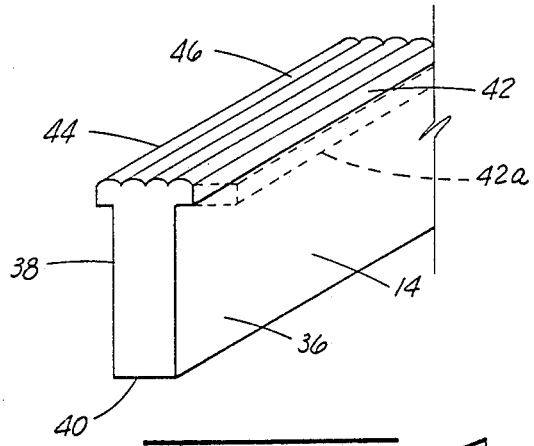
FIG. 4 is a perspective view of a longitudinal rail that is employed in the invention.

Referring to FIG. 4, the longitudinal rail 14 is formed of dimension so that sides 36 and 38 and bottom surface 40 are firmly received within the respective rail slots 16. The upper extremities of rail 14 may be formed variously, either plain or formed with a gripping surface as shown in FIG. 4. Thus, rail 14 includes formation of a T-shaped top structure which includes overhanging shoulders 42 and 44, and a top surface 46 which has abrading or gripping structure, in this case a series of longitudinal striations. As shown also in FIG. 1, the outermost rails 44 may include extended side shoulders **42*a* and 44*a*. Thus, the side shoulders 42*a* and 44*a* may extend outward to the opposite ends of cross bar 12**.

Figure 5:
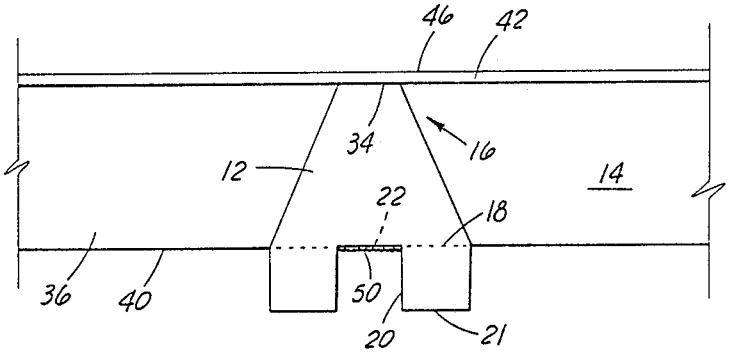
FIG. 5 is a side view in vertical elevation of a cross bar/longitudinal rail juncture as secured along the welding slot.

FIG. 5 illustrates a single junction between a cross bar 12 and a longitudinal rail 14 as it is engaged in the rail slot 16. The rail 14 is firmly seated within rail slot 16 with shoulders 42 and 44 firmly supported on top surface 34, and a weldment bead is drawn through weld slot 20 across surface 22 and the openings 23 to secure each respective rail 14 (i.e., bottom surface 40) to the cross bar 12.

Figure 6:
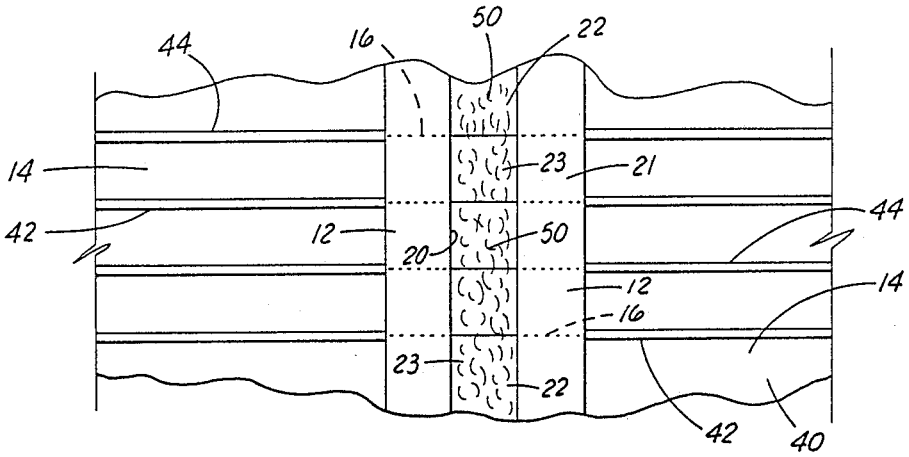
FIG. 6 is a bottom view of a portion of rail junctures along a cross bar showing the weld slot.

FIG. 6 illustrates a bottom view of a portion of cross bar 12 with bottom surface 21 having the center slot 20 formed therein. As the respective rail slots 16 are formed to a support level 18 (FIG. 5), the placement of the rails 14 within the slots 20 brings each bottom surface 40 of the respective rail 14 into the same plane, i.e., support plane or level 18, at openings 23 such that the weldment 50 can be drawn to best advantage. A helio-arc or other welding process can be utilized to draw the weldment across slot 20 generally through the center of central slot surface 22 thereby to provide equal and secure fastening of the cross bar 20 and multiple of rails 14. Additionally, aesthetic effects of the trench grating are enhanced by keeping the welds out of sight during installation.

In manufacture and assembly, the bar and rail stock is selected in accordance with the strength requirements of the finished grating system. As previously stated, the grating may be constructed of aluminum material but steel, bronze and other alloys may be employed as exigencies might dictate. The cross bars 12 may be formed in a unit operation of cutting and milling, and the individual rails 14, including whatever top surface 46, may be cut from standard bar or strip stock. Or, rails 14 may be extruded to provide simultaneously the additional shoulder or treading top structure 46. Rails 14 are then placed in rail slots 16 of a plurality of cross bars 12 and supported in temporary support or jigging structure whereupon a weldment 50 is drawn through the center slot 20 of each cross bar 12 to secure the components and produce a rigid section of trench grating.

The foregoing discloses a novel form of trench grating that can be constructed quickly and reliably from aluminum or other metal materials. Rigid securing of components may be made for each cross bar of the grating in a single overall weld movement, and the weld structure is disposed at the center of rigidity of each cross bar, i.e., at that point of the cross bar where maximum rigidity or least movement will be experienced under load condition. Trench gratings constructed in accordance with the present method require only a single weld drawing to secure all components, and the method avoids any activities of punching, crimping, slide engaging, or other diverse securing operations.

Changes may be made in combination and arrangements as heretofore set forth in the specification and shown in the drawings; it being understood that changes may be made in tee embodiments disclosed without departing from the spirit and scope of the invention as defined in the following claims.

What is claimed is:

1. A trench grating comprising:

plural, spaced solid metal cross bars each having top and bottom sides with plural, equi-spaced rail slots formed transversely of the cross bar in parallel and partially through the top side with each terminating at a support plane intermediate the top and bottom sides, and having a central weld slot formed longitudinally of the cross bar across the bottom side that also terminates in a surface at the support plane and forms central openings in communication with each of said rail slots;

plural metal support rails each aligned in a respective rail slot of the plural cross bars and resting at said support plane to define an upper tread surface; and a bottom weldment drawn along each of said cross bar central slots in the support plane thereby to secure each support rail to the respective cross bar at said support plane.

2. A trench grating as set forth in claim 1 wherein each said support rail comprises:

a uniform bar having generally rectangular cross-section with a shorter dimension side inserted to the support plane in respective rail slots while defining said upper tread surface.

3. A trench grating as set forth in claim 1 wherein each said support rail comprises:

an abrading surface structure formed on the upper tread surface of the rail.

4. A trench grating as set forth in claim 2 wherein said uniform bar comprises:

an abrading surface structure formed on the upper tread surface of the rail.

5. A trench grating as set forth in claim 1 which is further characterized in that:

said cross bars and support rails are aluminum.

6. A trench grating as set forth in claim 4 which is further characterized in that:

said cross bars and support rails are aluminum.

7. A trench grating as set forth in claim 1 wherein each said cross bar is further characterized in that:

said cross bar has transverse rail slots formed to a support plane with an opposite side central weld slot formed to the support plane at a respective slot depth ratio of about two to one.

8. A trench grating as set forth in claim 2 wherein said support rail further includes:

a T-shaped shoulder formed on the upper tread surface to broaden the overall effective tread surface.

9. A trench grating as set forth in claim 8 wherein:

said tread surface shoulder overhangs the cross bar in flush-fitting relationship.

10. A method for manufacturing a trench grating comprising:

forming plural, uniform metal cross bars of generally four-sided cross-section having generally parallel top and bottom surface, with plural spaced rail slots formed transversely across the top of the cross bar and a central weld slot formed lengthwise up within the bottom surface of the cross bar, and with each of said plural rail slots and said central weld slot terminating in communication at the same plane intermediate the top and bottom surfaces to define a respective plurality of openings;

placing a plurality of metal rail bars in said respective rail slots of each of the plural cross bars as disposed for support at said plane and in spaced parallel disposition; and drawing a weldment through the central weld slot and across the openings of each cross bar and the exposed rail bars thereby to secure and consolidate the grating structure.

11. A method as set forth in claim 10 wherein: said cross bars and said rail bars are aluminum.

12. A method as set forth in claim 10 wherein: said cross bars and said rail bars are steel.

13. A method as set forth in claim 10 wherein: said cross bars and said rail bars are bronze.

* * * * *